United States Patent [19]

Bellino et al.

[11] Patent Number: 4,476,995

[45] Date of Patent: Oct. 16, 1984

[54] BREATHER CAP

[75] Inventors: Ralph R. Bellino, Brunswick; Charles W. McVey, Chardon, both of Ohio

[73] Assignee: American Industries, Cleveland, Ohio

[21] Appl. No.: 313,191

[22] Filed: Oct. 20, 1981

[51] Int. Cl.[3] ..... B65D 51/16

[52] U.S. Cl. ..... 220/371; 220/303; 220/374; 220/DIG. 32

[58] Field of Search ..... 220/371-374, 220/303, 304, DIG. 32, DIG. 33; 55/385 C, 505; 285/360, 376, 401

[56] References Cited

U.S. PATENT DOCUMENTS

| | | | |
|---|---|---|---|
| D. 107,250 | 11/1937 | Nehl . | |
| 1,685,841 | 10/1928 | Farmer . | |
| 1,716,024 | 6/1929 | Bell | 220/304 X |
| 1,923,338 | 8/1933 | Stant | 220/304 X |
| 2,117,369 | 5/1938 | Shaw . | |
| 2,135,351 | 11/1938 | Nehl . | |
| 2,154,113 | 4/1939 | Smith | 220/203 |
| 2,185,899 | 1/1940 | Padlock . | |
| 2,187,264 | 1/1940 | Carlson . | |
| 2,371,296 | 3/1945 | Hopwood . | |
| 2,603,368 | 7/1952 | McCall . | |
| 2,696,100 | 12/1954 | Nehls . | |
| 2,796,192 | 6/1957 | Nehls . | |
| 2,797,841 | 7/1957 | Kapp . | |
| 2,880,604 | 4/1959 | Nehls . | |
| 2,880,605 | 4/1959 | Nehls . | |
| 2,880,903 | 4/1959 | Nehls . | |
| 3,126,728 | 3/1964 | Nehls . | |
| 3,163,315 | 12/1964 | Wilson . | |
| 3,255,743 | 6/1961 | Kolbe et al. . | |
| 3,351,497 | 6/1966 | Kolbe et al. | 220/373 X |
| 3,422,982 | 1/1969 | Terwoerds et al. | 220/374 X |
| 4,051,975 | 10/1977 | Ohgida et al. . | |
| 4,081,102 | 3/1978 | Sakai . | |
| 4,157,707 | 6/1979 | Schwind et al. | 220/374 X |
| 4,271,977 | 6/1981 | Saigne | 220/371 |
| 4,319,640 | 3/1982 | Brobeil | 220/372 X |

FOREIGN PATENT DOCUMENTS

| | | | |
|---|---|---|---|
| 2155854 | 5/1973 | Fed. Rep. of Germany | 220/204 |

*Primary Examiner*—William Price
*Assistant Examiner*—Gary E. Elkins
*Attorney, Agent, or Firm*—Browdy and Neimark

[57] ABSTRACT

A breather cap having a foam filter element and means to permit vapors from the crankcase, manifold or the like to which the cap is attached to pass freely in and out of the cap and between the cap and atmosphere. The invention cap includes a twist-in mounting feature, and an improved assembly method.

8 Claims, 3 Drawing Figures

BREATHER CAP

BACKGROUND OF THE INVENTION

This invention relates to engines and more particular it relates to a breather cap for crankcases, manifolds, valve covers and the like to permit air flow through a filter element between atmosphere and the space within the crankcase or the like. The invention includes the method of manufacturing such a cap. Alternatively, the invention lends itself to incorporation with pollution control devices and the like. Still more particularly, the invention includes the combination of a breather cap of the character described with twist-in locking fingers common in other areas, such as fuel tank caps and the like.

The term "breather cap" as used in the specification and claims herein shall be understood to mean a filter element through which air flow is directed between two or more spaces, as for example in the environments described immediately above. The term "crankcase" shall likewise include all such spaces with which the invention cap may be used.

The invention method permits the making of a plated breather cap. Heretofore, it was difficult to plate breather caps because of problems related to the sealing means. The invention avoids these problems and can easily produce a plated product having all of the other advantages of the invention cap.

Heretofore, many crankcase breather caps have been of the so called "push-in" variety. These depend on simple spring fingers which cooperate with some part of the engine or valve cover or the like to hold the cap in place. This is undesirable for many reasons, including that the springs can loosen, they can form a less than air-tight seal, and the springs often have sharp edges which can injure users handling them.

Some crankcases have sealing closure caps which twist-in, but which are not breather caps. Those devices are not pertinent to the present invention. The present invention comprises a combination of the twist-in feature and the breather feature which combination is thought to be non-existant in the prior art.

Another type of prior-art device, less commonly used, is a screw in type wherein the breather cap has a threaded neck which cooperates with a threaded opening. This is undesirable for a number of reasons, including that the thread can be put in skewed and it requires more time and manipulation than the quarter to half-turn used in the invention cap. It is also more complicated and expensive to manufacture.

The invention also provides an improved manner of assembly and of fabricating the locking fingers required by the twist-in attachment method. This comprises an additional sleeve positioned around the throat portion of the base plate, with the finger portions being formed simultaneously in the throat and sleeve portions such that the part is rigidified and the radial extent of the fingers is increased. This sleeve provides important advantages including reduction of assembly time, reduction of tooling, and the ability to plate the parts of the cap prior to assembly and to thereafter put on sealing means and capture those sealing means in place by forming the locking fingers in the sleeve.

BRIEF DESCRIPTION OF THE DRAWINGS

The above and other advantages of the invention will be pointed out or will become evident in the following detailed description and claims, and in the accompanying drawing also forming a part of this disclosure, in which:

DETAILED DESCRIPTION OF THE DRAWINGS

Figure 2:
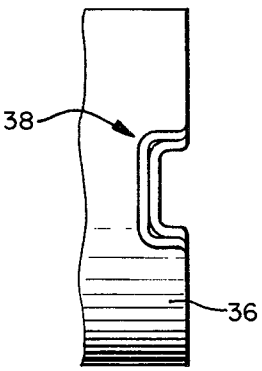
FIG. 2 is a partial plan view taken on line 2—2 of FIG. 1 to illustrate a detail.
Figure 3:
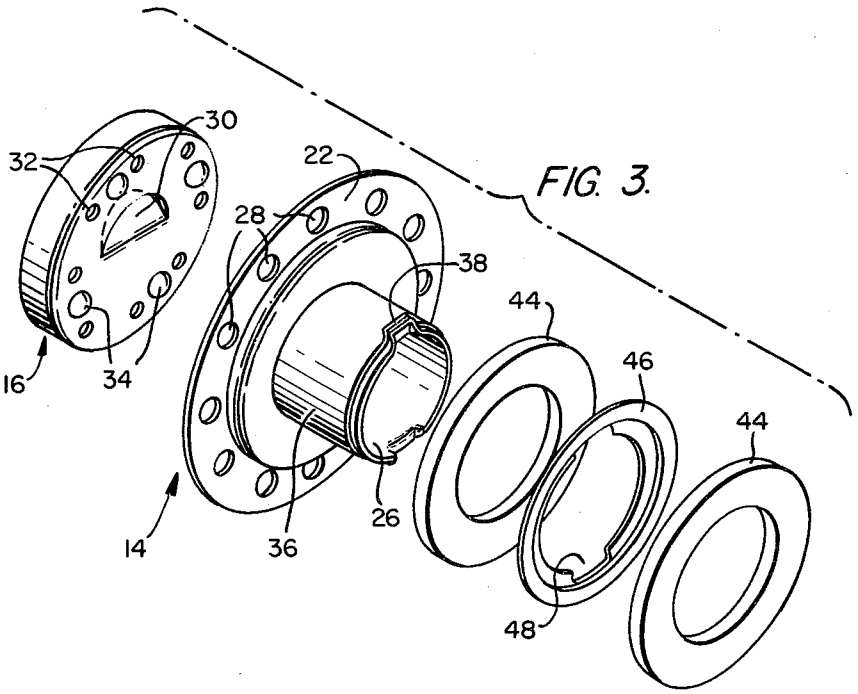
FIG. 3 is an exploded view of several parts showing the assembly of the invention.

Referring now in detail to the drawings, a preferred embodiment of the breather cap 10 of the invention comprises a top member 12 and a base member 14. An inner baffle 16 fits within a suitably formed portion of the base 14 and holds a filter member 18 in position inside the top 12. The filter element 18 per se is well known to those skilled in these arts, and it may comprise any suitable material, plastic foams are generally preferred.

Top 12 is of generally cup-like configuration and its outer edge is formed and turned as at 20 to grasp the outer peripheral edge 22 of the base member 14. The three large metal parts 12, 14 and 16 of the invention breather cap with the foam element 18 held in place are thus secured together.

After edge portion 22 base 14 comprises a recess or pocket portion 24 and is then completed by an outer neck portion 26. Recess portion 24 snugly receives the inner baffle 16. Edge portion 22 is formed with a plurality of air flow openings 28.

As indicated by the various arrows, paths for air flow are provided through the inside of throat portion 26 and baffle 16, into the filter element 18, and then out through openings 28. To this end, inner baffle 16 is formed with a central arcuate cut-out 30, a plurality of openings 32, and a plurality of dimples 34 which fit against the inside of the recess portion 24, on the radial wall thereof, to provide a stand-off between the inner baffle 16 and this portion 24 of the base member 14.

A sleeve 36 is provided around the outside of the throat portion 26, and this sleeve is co-terminus with the throat portion.

The sleeve 36 is provided for the purposes of facilitating plating and assembly, reducing the number of component parts, reducing manufacturing tooling, and strengthing the finger portions 38. Heretofore, there were problems in plating breather caps because plating on the sealing washers and springs 44 and 46 (described below) would be detrimental to normal operation. Using the sleeve 36, the invention method is: (1) plate all the metal parts; (2) assemble all the parts including the washers; and (3) deform the ends of the throat 26 and the sleeve 36 into finger portions 38 to hold the sealing parts 44 and 46 in place while strengthing these fingers. Prior art devices require several more parts, entail more complicated assembly procedures, cause great difficulty in plating, and requiring more complex manufacturing tooling. The invention tooling as to this aspect is one relatively simple tool which deforms the ends of parts 26 and 36 into finger portions 38.

Figure 1:
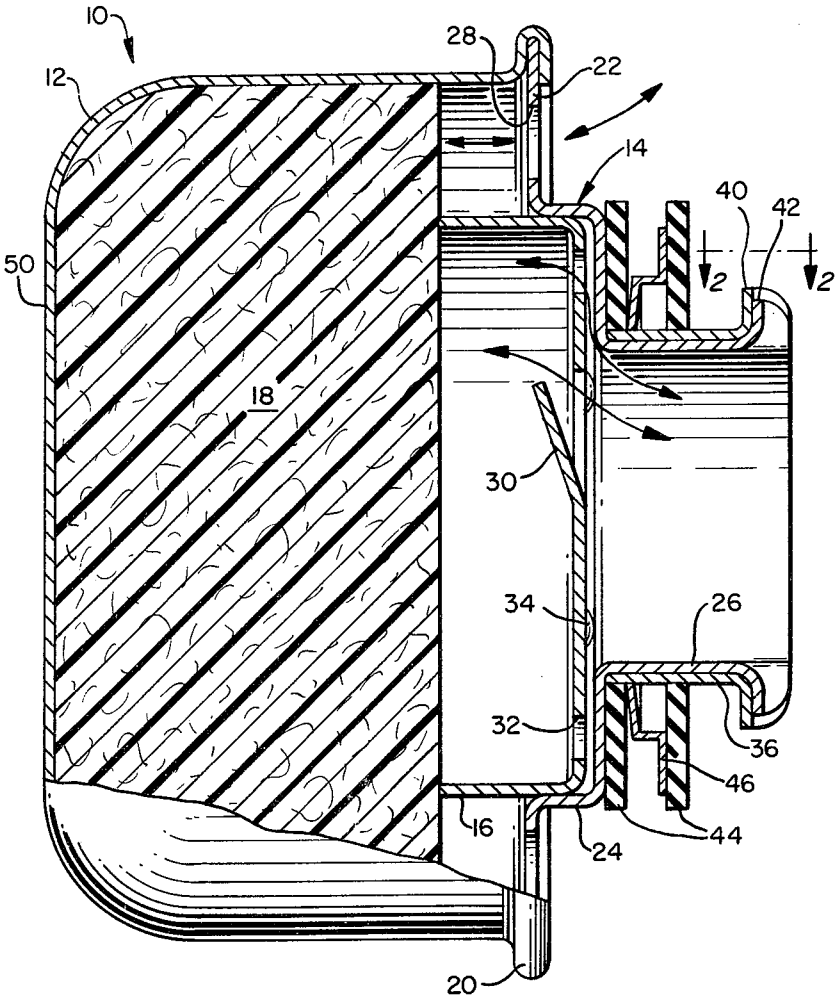
FIG. 1 is a cross-sectional view of a breather cap embodying the invention.

The sleeve 36 is assembled on the throat portion 36, and thereafter the finger portions 38 are formed, thus securing the sleeve to the throat portion and providing the greater radial extent of the fingers, greater rigidity, and other advantages, as discussed above. Referring to FIG. 1, it can be seen that the sleeve 36, in the vicinity of the fingers 38 extends out further at 40 than does the formed section of the throat, which extends out only as far as 42.

Means is provided to seal the cap 10 in place in an opening to which it is held by twisting of the finger portions 38, in the usual manner for this type of twist-on sealing lock arrangment. To this end, there is provided a pair of rubber or other elastomeric material washers 44 which sandwich a spring washer 46 between themselves. The resiliency of spring 46 in the axial direction, in combination with the rubber washers 44 provide a fluid tight seal in a secure manner, in a manner familiar to those skilled in these arts. The spring washer 46 is also formed with cut-outs 48 to aide in assembly.

The invention is also amenable to use in applications where there are three conduits for air flow, or where the flow is directly through the filter element. That is, the top wall 50 of the top member 12 could be provided with a nozzel, opening, or the like for cooperation with a hose or conduit from some other part of the engine, or for other flows in other environments. In such case, one or the other of the flows through the openings 28 or through the throat portion 26 could be blocked off, and the flow would be directly through the filter element and in or out of the this additional means provided in wall 50. An application might be, for example, in a modern automobile engine where it is necessary to connect more than one flow path to and from the crankcase together with fresh air. A modification of the invention cap to that extent is deemed possible.

While the invention has been described in detail above, it is to be understood that this detailed description is by way of example only, and the protection granted is to be limited only within the spirit of the invention and the scope of the following claims.

We claim:

1. A breather cap, comprising the combination of:

a top housing including a filter element;

a base secured to said top housing, said base comprising a throat portion and twist-on connection means formed in said throat portion, said base and top housing cooperating to define means for reversibly conducting gaseous fluid through said cap and through said filter element;

and a sleeve member assembled on said throat portion, said twist-on connection means comprising finger means extending radially outwardly of said throat portion and said sleeve member, and said finger means being formed in said throat portion and in said sleeve member such that the ends of said sleeve member in said finger means extend radially outwardly further than the corresponding parts of said throat portion in said finger means.

2. The combination of claim 1, and further comprising sealing means positioned about said sleeve member for cooperation with said twist-on connection means to form a fluid tight seal between said cap and a crankcase or the like to which said cap may be secured.

3. The combination of claim 2, said sealing means comprising a pair of sealing washers and a spring washer sandwiched between.

4. The combination of claim 1, said base being formed with a recess, and said conducting means comprising an inner baffle positioned in said base recess in contact with said filter element, stand-off means between said inner baffle and said recess to form an air flow space therebetween, and said inner baffle and said base being formed with air flow openings, whereby air flow passageways are formed through said throat portion, through the openings in said inner baffle, around said stand-off means, through said filter element, and through said base air flow openings.

5. The combination of claim 4, said inner baffle being of cup-like configuration, said baffle air flow openings and said stand-off means being formed in the bottom radial wall thereof, said stand-off means comprising a plurality of axially extending dimples in said inner baffle bottom wall, said dimples being configured and positioned so as to contact the juxtapositioned portions of said base recess to thereby provide said air flow passageway therebetween, and said air flow means further comprising an arcuate cut-out formed centrally in said inner baffle bottom wall for direct communication between said filter element and the space inside said base throat portion.

6. In a breather cap including a housing, a filter element contained within said housing and a base connected to said housing, said base including means for connecting said breather cap to a supporting member, the improvement comprising:

means for holding said filter element spaced away from said base, a first portion of said holding means being disposed adjacent said filter element, and a second portion of said holding means being disposed adjacent said base, and said filter element cooperating with said base and said holding means to define therebetween a plurality of chambers comprising means for reversibly conducting a fluid on one side of the supporting member to the other side of the supporting member, said base including a first portion adjacent said housing and overlying said filter element, and a second portion disposed centrally of said first portion, said second portion defining a throat portion and including a sleeve disposed thereon, said twist-on connection means including finger means extending radially outwardly of said throat portion and said sleeve member, and said finger means being formed in said throat portion and in said sleeve member such that the ends of said sleeve member in said finger means extend radially outwardly further than the corresponding parts of said throat portion in said finger means.

7. The improvement of claim 6, wherein said holding means is cup-shaped having a mouth portion and a pervious base portion, said throat portion defining a first of said chambers and said holding means defining a second of said chambers.

8. The improvement of claim 7, wherein said base first portion includes a plurality of openings therethrough and said filter element cooperates with said base first portion, said housing, and said holding means to define a third of said chambers.

* * * * *